US008807726B2

(12) United States Patent
Doi et al.

(10) Patent No.: US 8,807,726 B2
(45) Date of Patent: Aug. 19, 2014

(54) INKJET RECORDING APPARATUS

(75) Inventors: Tsukasa Doi, Yokohama (JP); Kiichiro Takahashi, Yokohama (JP); Akiko Maru, Tokyo (JP); Takatoshi Nakano, Yokohama (JP); Genji Inada, Koshigaya (JP); Satoshi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 13/553,451

(22) Filed: Jul. 19, 2012

(65) Prior Publication Data

US 2013/0021397 A1 Jan. 24, 2013

(30) Foreign Application Priority Data

Jul. 23, 2011 (JP) ..... 2011-161442

(51) Int. Cl.

| | |
|---|---|
| ***B41J 2/19*** | (2006.01) |
| ***B41J 2/045*** | (2006.01) |
| *B41J 2/195* | (2006.01) |
| *B41J 2/175* | (2006.01) |

(52) U.S. Cl.

CPC ..... *B41J 2/04563* (2013.01); *B41J 2/0458* (2013.01); *B41J 2/195* (2013.01); *B41J 2/17566* (2013.01)

USPC ..... 347/92

(58) Field of Classification Search

CPC .... B41J 29/393; B41J 2/04563; B41J 2/0458; B41J 2/195; B41J 2/17566

USPC ..... 347/6, 7, 17, 19, 25, 29, 30, 84, 85, 92, 347/97

See application file for complete search history.

(56) References Cited

U.S. PATENT DOCUMENTS

| | | | | |
|---|---|---|---|---|
| 6,871,925 | B2 * | 3/2005 | Yamamoto et al. | 347/6 |
| 7,134,748 | B2 * | 11/2006 | Nakamura et al. | 347/87 |

FOREIGN PATENT DOCUMENTS

| | | |
|---|---|---|
| JP | 2008-62450 A | 3/2008 |
| JP | 2010-52393 A | 3/2010 |

* cited by examiner

*Primary Examiner* — An Do

(74) *Attorney, Agent, or Firm* — Canon USA Inc. IP Division

(57) ABSTRACT

An inkjet recording apparatus capable of determining an amount of bubbles in an ink flow path and performing suction recovery operation at an appropriate timing is provided. The inkjet recording apparatus includes a recording head including a nozzle for discharging ink and a flow path forming member forming an ink flow path for supplying the ink to the nozzle, a suction unit configured to suck the ink from the recording head, and a temperature detection unit configured to detect a temperature in the recording head. The inkjet recording apparatus includes a control unit configured, based on an amount of gas in the flow path forming member before the ink is filled in the ink flow path, and an amount of gas in equilibrium in the flow path forming member after the ink is filled in the ink flow path, to control the operation of the suction unit.

9 Claims, 18 Drawing Sheets

FIG.10

| STORAGE TEMPERATURE [°C] | WORKING TEMPERATURE [°C] | MAXIMUM AMOUNT OF BUBBLE GROWTH |
|---|---|---|
| 5 | 5 | 8.8 |
| 5 | 15 | 33.6 |
| 15 | 15 | 11.8 |
| 15 | 23 | 31.6 |
| 23 | 23 | 14.1 |
| 23 | 30 | 31.5 |

INKJET RECORDING APPARATUS

BACKGROUND OF THE INVENTION

1. Field of the Invention

The present invention relates to an inkjet recording apparatus having a suction recovery unit configured to maintain a discharge state of a recording head for discharging ink for recording.

2. Description of the Related Art

In an inkjet recording head for discharging ink for recording, bubbles grow in a flow path from an ink tank to a discharge nozzle, and in a liquid chamber. When the bubbles reach the discharge nozzle, the ink is unable to be discharged, resulting in a poor image. To solve the problem, conventionally, a suction recovery operation for forcibly discharging the bubbles from the flow path by blocking the nozzle side of the recording head with a cap to reduce the pressure is regularly performed.

The suction recovery for removing the bubbles is called timer suction in which the timing of the suction operation is controlled according to the elapsed time since the last suction operation. The time to the next suction recovery in the timer suction is set such that the bubble growth amount in the flow path does not cause the discharge failure. However, it is known that the rates and amounts of the growth of bubbles vary depending on the usage environment of the inkjet recording apparatus body and the elapsed time since arrival suction. Accordingly, if the time from the last suction operation to the next suction operation is set to constant, the suction may be performed too often or suction failure may occur by the time the next suction operation is performed.

To solve the problems, the following known techniques are discussed. Japanese Patent Application Laid-Open No. 2010-52393 discusses a configuration for correcting a count value of elapsed time by acquiring a temperature of a recording head at regular intervals such that the count value increases as the temperature increases because bubbles in the head flow path grow faster as the temperature increases.

Japanese Patent Application Laid-Open No. 2008-62450 discusses a configuration for increasing an interval of timer suction as the accumulated number of recovery processes in the timer suction increases because the growth of bubbles becomes slow as the elapsed time since ink filling into an ink flow path increases.

Japanese Patent Application Laid-Open No. 2010-52393, however discusses a technique in which the correction amount of the elapsed time count in the timer suction is uniquely determined by the absolute value of the temperature at the temperature acquisition timing. Accordingly, the suction operation is performed at the regular intervals as long as the temperature is constant. However, this does not match the actual phenomenon that the growth of bubbles becomes slow with time from the time the ink is filled into the ink flow path discussed in Japanese Patent Application Laid-Open No. 2008-62450. In other words, the suction frequency becomes too high after the growth of bubbles becomes slow.

In Japanese Patent Application Laid-Open No. 2008-62450, the time interval is set based on the result of study in a high-temperature environment in which the rate of the growth of bubbles is high. The description lacks the concept that the rate of the growth of bubbles varies depending on the temperatures of the recording head discussed in Japanese Patent Application Laid-Open No. 2010-52393. As a result, when the inkjet recording apparatus is used in a room temperature environment, the suction timing becomes too early with respect to the amount of bubbles, and the suction frequency unnecessarily increases. Further, when the number of times of the timer suction operations increases, and the temperature in the usage environment of the inkjet recording apparatus increases after the interval of the timer suction is increased, the growth of bubbles may become faster than expected. As a result, a discharge failure may occur before the next suction timing.

SUMMARY OF THE INVENTION

The present invention is directed to providing an inkjet recording apparatus that can calculate an amount of bubbles in an ink flow path and perform a suction recovery operation at an appropriate timing.

According to an aspect of the present invention, an inkjet recording apparatus including a recording head including a nozzle for discharging ink and a flow path forming member forming an ink flow path for supplying ink to the nozzle, a suction unit configured to suck the ink from the recording head, and a control unit configured, based on an amount of gas in the flow path forming member before the ink is filled in the ink flow path, and an amount of gas in equilibrium in the flow path forming member after the ink is filled in the ink flow path, to control the operation of the suction unit is provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 10 is a diagram illustrating maximum amounts of bubble growth when storage temperatures and working temperatures are changed.

FIG. 18 is a flowchart illustrating a control procedure in initial time reception performed after hard power on.

DESCRIPTION OF THE EMBODIMENTS

Various exemplary embodiments, features, and aspects of the invention will be described in detail below with reference to the drawings.

Figure 1:
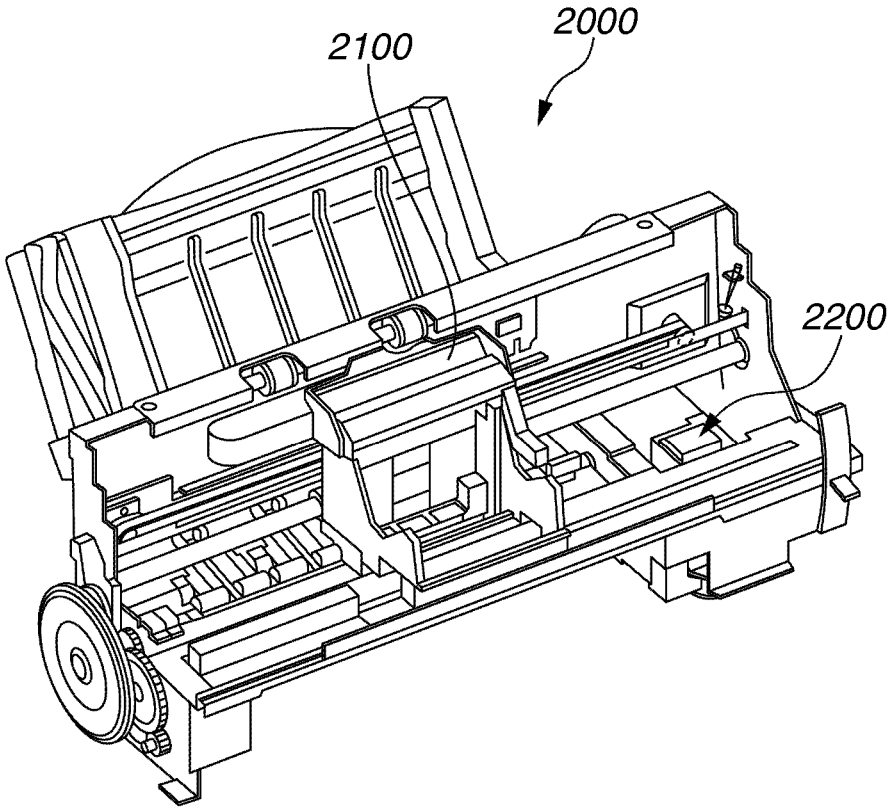
FIG. 1 illustrates a recording unit in a recording apparatus unit according to an exemplary embodiment of the present invention.

A configuration of an inkjet recording apparatus according to an exemplary embodiment of the present invention will be described. With reference to FIG. 1, a recording unit in a recording apparatus unit 2000 will be described. The recording unit includes a carriage 2100 movably supported with a carriage shaft 2103 and a recording head 4000 detachably mounted on the carriage 2100. The recording head 4000 includes a temperature detection sensor in the head. A discharge recovery unit 2200 performs recovery processing for maintaining a discharge state of the recording head 4000 in a good state.

Figure 2:
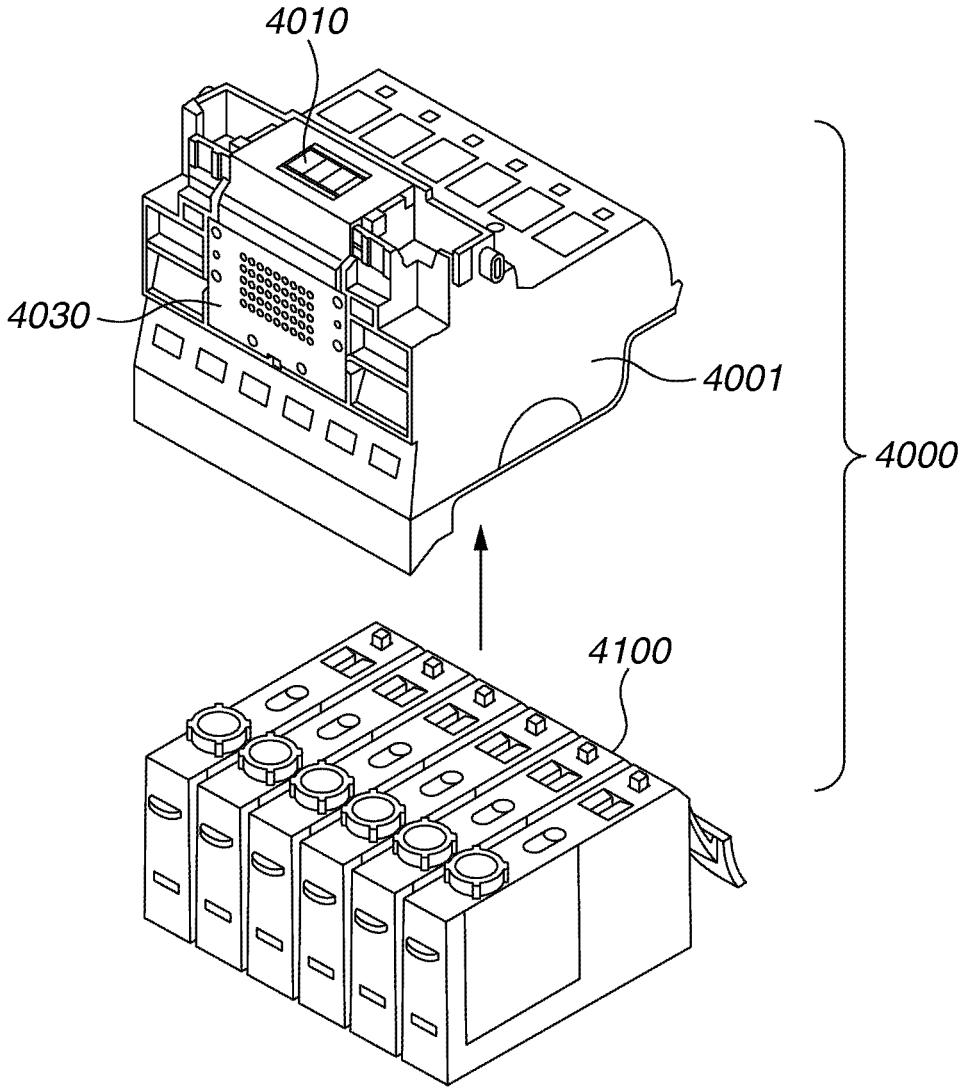
FIG. 2 illustrates a state ink tanks are removed from a recording head.

FIG. 2 illustrates a state ink tanks are removed from the recording head in an upside down state. The ink tanks 4100 include ink tanks of black, light cyan, light magenta, cyan, magenta, and yellow which are respectively independent. The respective ink tanks can be detached from a recording head body 4001.

Figure 3:
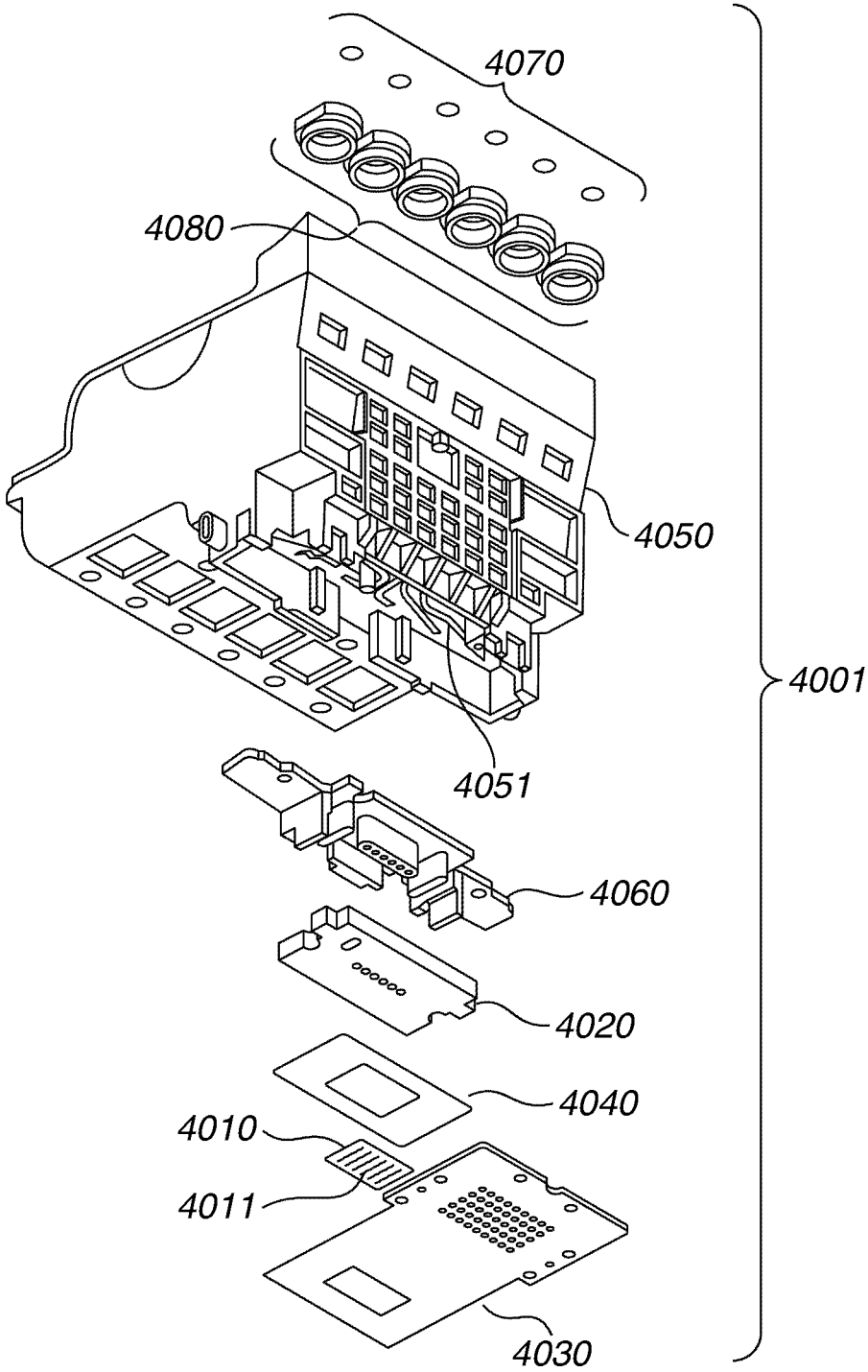
FIG. 3 is an exploded perspective view illustrating the recording head body.

FIG. 3 is an exploded perspective view illustrating the recording head body 4001. The recording head body 4001 according to the exemplary embodiment includes a recording element substrate 4010, a first plate 4020, an electric wiring substrate 4030, a second plate 4040, a tank holder 4050, an ink flow path forming member 4060, a filter 4070, and a seal rubber 4080.

In the recording element substrate 4010, on one side of the silicon substrate, a plurality of recording elements for discharging ink and the electrode wiring of aluminum or the like for supplying electric power to each recording element are formed using a film formation technique. While a plurality of nozzles having a plurality of ink flow paths and a plurality of discharge ports 4011 corresponding to the recording elements are formed, a plurality of ink supply ports for supplying ink to the ink flow paths are formed such that the ports open on the back surface. The recording elements discharge ink using thermal energy. The recording elements include an electrothermal converter for generating the thermal energy. In other words, the thermal energy generated by the electrothermal converter causes film boiling of the ink, and using pressure change caused by the growth and contraction of bubbles in the ink, the ink is discharged from the discharge port.

To the tank holder 4050 for detachably holding the ink tank 4100, the ink flow path forming member 4060 is welded and fixed by ultrasonic welding or the like. By the structure, an ink flow path 4051 from the ink tanks 4100 to the first plate 4020 is formed. To an end portion at the ink tank side in the ink flow path 4051 that fits with the ink tanks 4100, the filter 4070 is provided to keep out dust from the outside.

Figure 4:
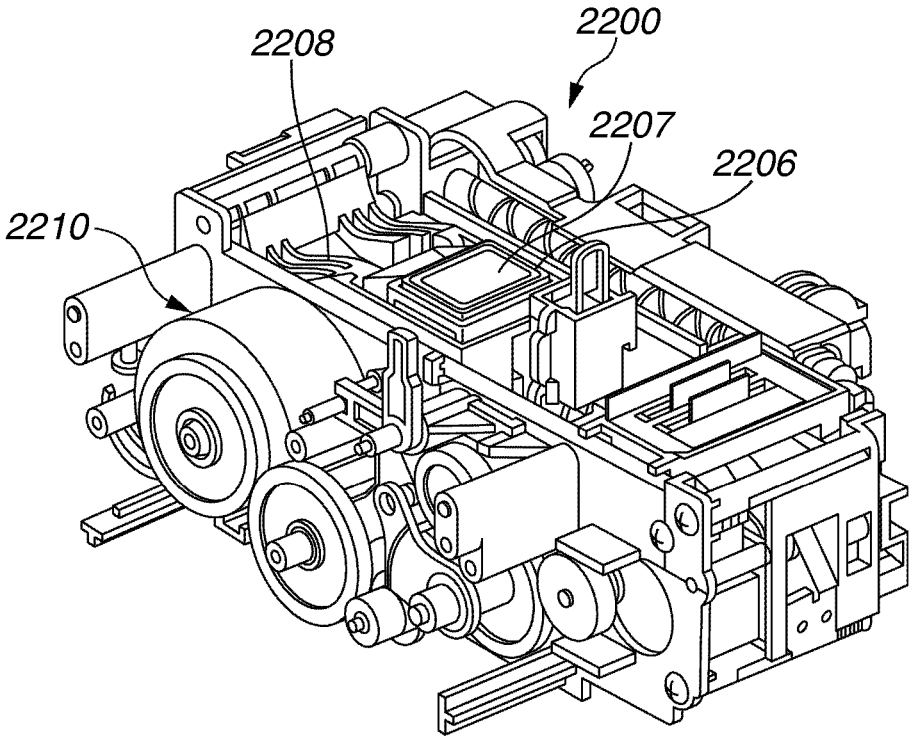
FIG. 4 illustrates a discharge recovery unit.
Figure 5:
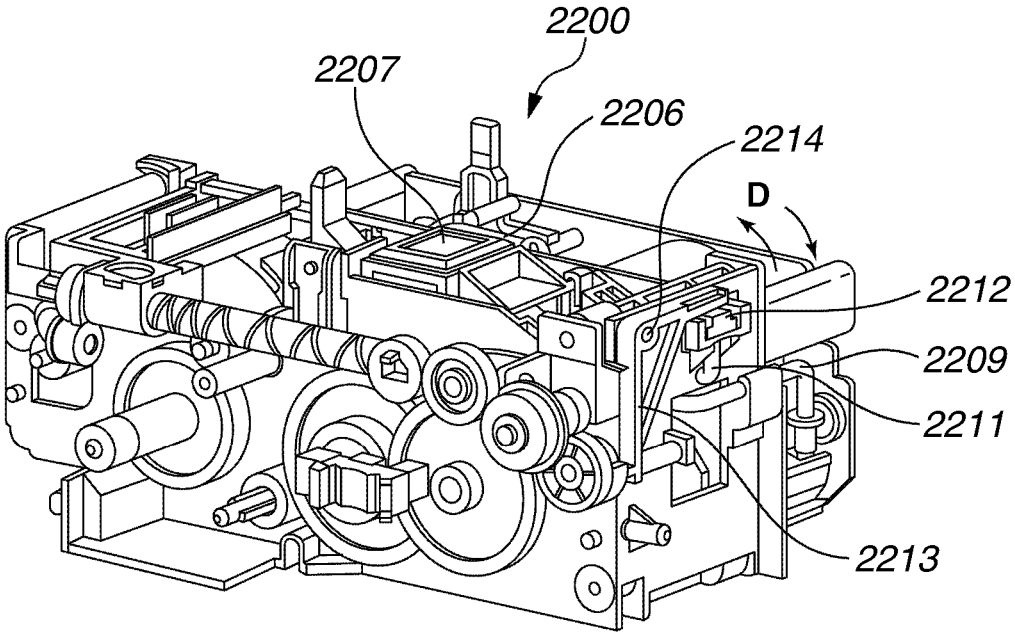
FIG. 5 illustrates the discharge recovery unit.

The discharge recovery unit according to the exemplary embodiment will be described with reference to FIGS. 4 and 5. FIG. 4 is a perspective view illustrating the discharge recovery unit. FIG. 5 is a perspective view illustrating the discharge recovery unit viewed from a direction different from FIG. 4. The discharge recovery unit is provided outside a region (recording region) where the carriage 2100 equipped with the recording head 4000 reciprocates for recording operation. The discharge recovery unit performs recovery processing for maintaining a discharge state of the recording head 4000 in a good state. The discharge recovery unit 2200 includes a wiping unit for removing foreign matter adhering to the recording element substrate 4010 in the recording head 4000. The discharge recovery unit 2200 further includes a suction recovery unit for normalizing the ink supply in the ink flow path from the ink tank 4100 to the recording element substrate 4010 in the recording head 4000.

The suction recovery unit includes a cap 2206 formed of a rubber, or the like. The cap 2206 can cover the recording element substrate 4010 in the recording head 4000. The cap 2206 includes an absorber 2207 in the cap. The cap 2206 is supported by a cap holder. The cap holder is supported by an arm 2208 that can swing around a fulcrum as a center.

The cap 2206 is connected with a pump 2210 by a tube 2209. When the pump 2210 is operated, the ink is absorbed from the recording head 4000 covered with the cap 2206. Between the cap 2206 and the pump 2210, an atmospheric air communication tube 2211 including an atmospheric air communication valve 2212 is provided.

The atmospheric air communication valve 2212 is formed of a rubber, or the like. An atmospheric air communication arm 2213 that can abut on the valve and separate from the valve is provided such that the arm can rotate in the D direction in the drawing about an axis 2214. The atmospheric air communication arm 2213 is caused to abut on the atmospheric air communication valve 2212, and the pump 2210 is operated. Thereby the ink is absorbed from the recording head 4000. When the pump 2210 is operated in a state the atmospheric air communication arm 2213 is separated from the atmospheric air communication valve 2212, even if the cap 2206 abuts on the recording head 4000, the ink is not absorbed from the recording head 4000, and the ink in the cap 2206 is absorbed.

Figure 6:
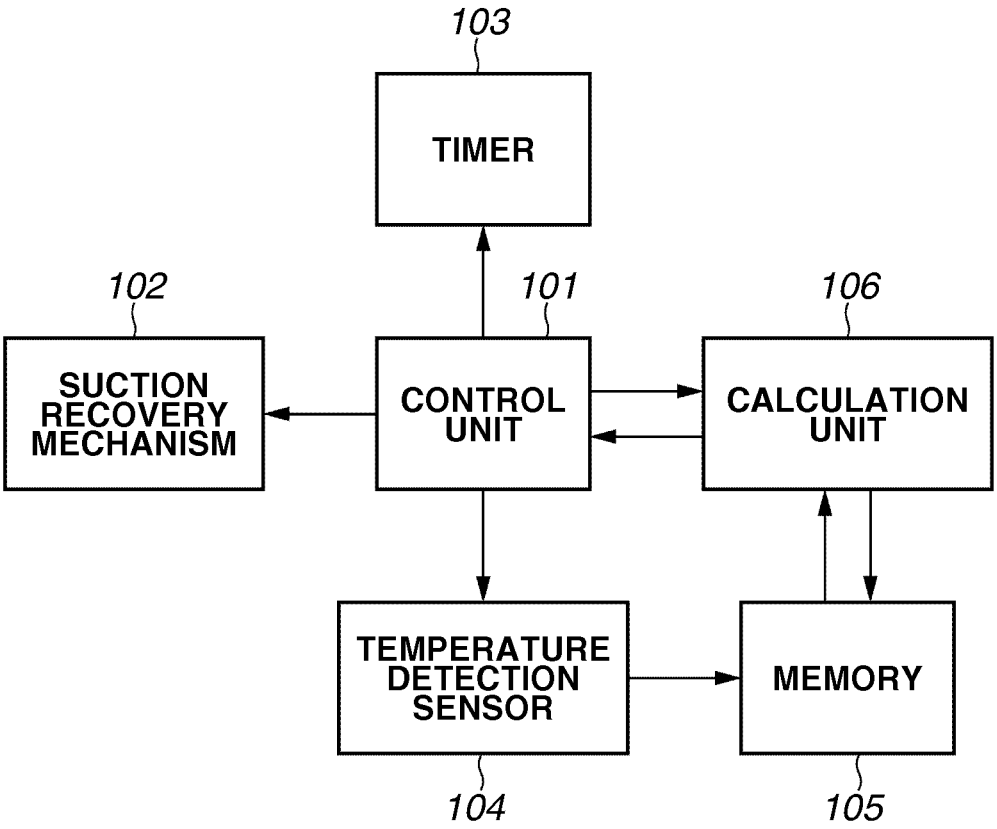
FIG. 6 is a block diagram illustrating a control unit.

The flow of the suction recovery operation control performed in the inkjet recording apparatus of the above-described configuration will be described. FIG. 6 is a block diagram illustrating a control unit according to the exemplary embodiment of the present invention. A control unit 101 performs control of issuing an instruction of suction recovery operation to a suction recovery mechanism 102. The control unit 101 also issues a temperature acquisition instruction to a temperature detection sensor 104 based on a count value of a timer 103. The control unit 101 also instructs a calculation unit 106 to calculate an amount of bubbles in the flow path based on the count value of the timer 103.

Figure 7:
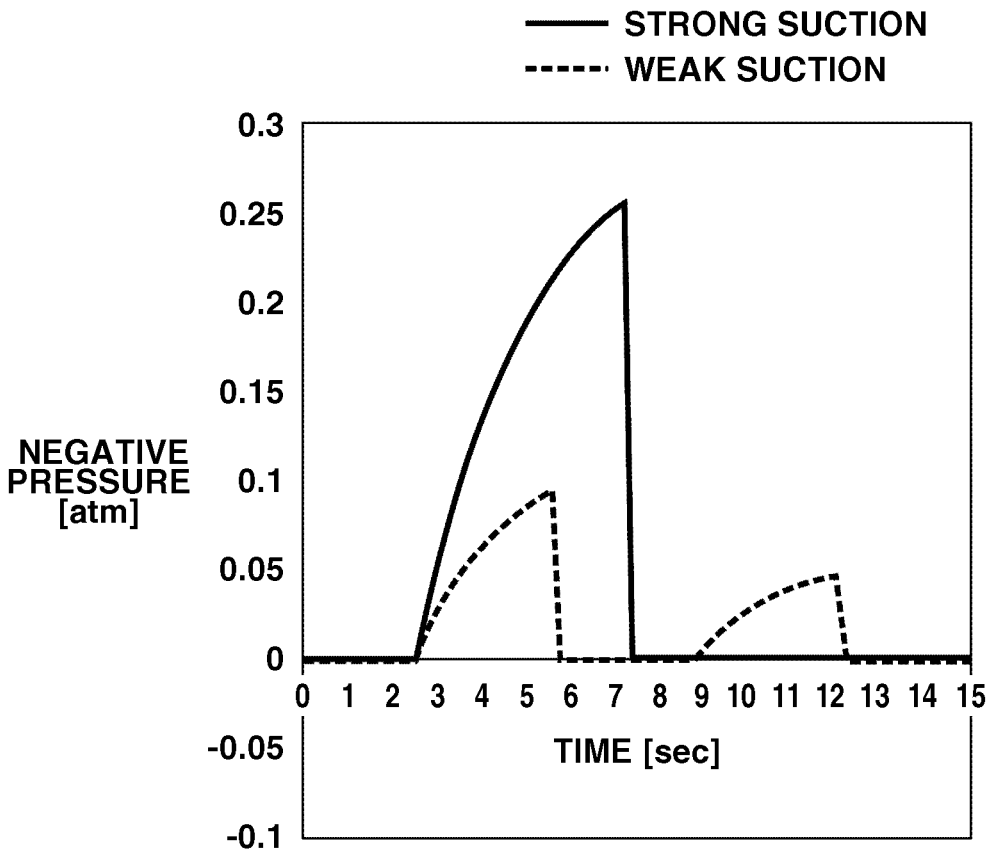
FIG. 7 illustrates a negative pressure waveform in a cap when strong suction and weak suction is performed.

The suction recovery mechanism 102 can perform strong suction and weak suction. The strong suction is for arrival suction and for removal of bubbles. The weak suction is for preventing fixation of nozzles and for removing dust. FIG. 7 illustrates a negative pressure waveform in the cap 2206 when the strong suction and the weak suction was performed in the exemplary embodiment. In the strong suction, as compared to the weak suction, the suction rate is to be increased, and the suction amount is to be increased. Depending on flow path shapes and characteristics of ink tanks, the suction rate, the suction amount, the number of operations of suction, or the like may be changed.

The timer 103 starts time measurement from the time when update of the amount of bubbles in the flow path is executed to determine the timing for acquiring the temperature in the head, and the timing for estimating the amount of bubbles in the flow path. The temperature detection sensor 104 acquires the temperature in the head in response to an instruction from the control unit 101. The calculation unit 106 calculates the amount of bubbles in the flow path based on information stored in a memory 105.

The flow of the bubble amount estimation processing according to the exemplary embodiment will be described. Conventionally, it has been thought that the growth of bubbles in an ink flow path is mainly caused by (1) gas permeation due to a difference between a concentration of the air in an ink flow path and a concentration of the air outside a flow path forming member, or (2) separation of gas in an ink solution. However, from a study, the inventor concluded that the growth of bubbles is mainly caused by desorption and separation of gas molecules absorbed or dissolved in a flow path forming member. The reasons will be described below.

Figure 8:
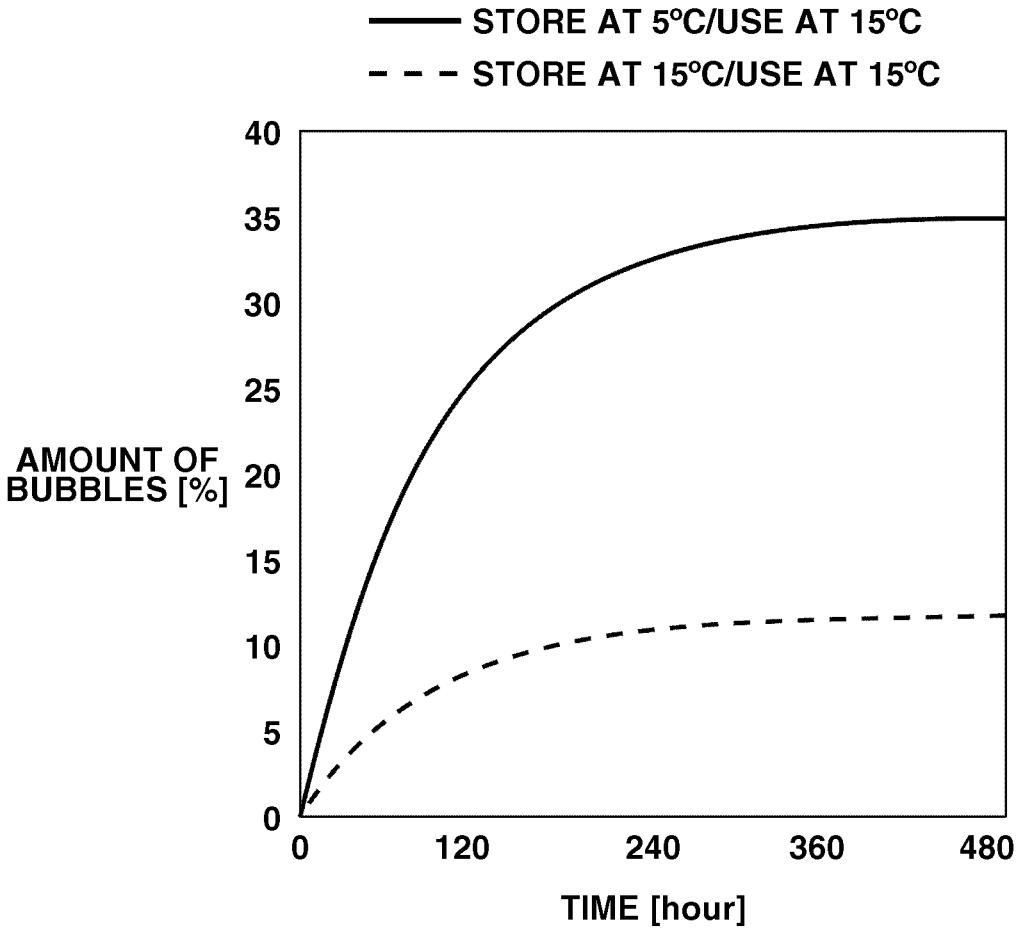
FIG. 8 is a diagram illustrating change in the amount of bubbles due to differences in temperatures the recording head was stored prior to arrival suction.

FIG. 8 is a diagram illustrating change in the amount of bubbles due to differences in temperatures the recording head was stored prior to arrival suction. The recording head is stored in a predetermined environment in a state the ink is not filled. After the storage, the ink is filled in the recording head by performing arrival suction in a working environment. In FIG. 8, the bubble growth curve observed in the environment of "STORE AT 5° C./USE AT 15° C." is illustrated. In the environment, the recording head is stored in the environment of the temperature of 5° C. and the humidity of 10% for one month in a state the ink is not filled, and the arrival suction is performed in the working environment of the temperature of 15° C. In FIG. 8, the bubble growth curve observed in the environment of "STORE AT 15° C./USE AT 15° C." is illustrated. In the environment, the recording head is stored in the environment of the temperature of 15° C. and the humidity of 10% for one month in a state the ink was not filled, and the arrival suction is performed in the working environment of the temperature of 15° C. For the arrival suction, ink that is adjusted to the working environment is used.

In FIG. 8, the vertical axis indicates the rate of the generated bubbles with respect to the ink flow path volume. The bubble growth curve is obtained by sequentially observing bubbles in the recording head by X-ray computed tomography (CT), and plotting quantified results from the CT images. The horizontal axis indicates elapsed time since the arrival suction is performed.

Hereinafter, the temperature in the environment where the recording head has been stored before the arrival suction is called "storage temperature". If not specified, the humidity is 10%, and the storage period is one month. Further, the temperature in the environment where the recording head is used after the arrival suction is called "working temperature".

If it is assumed that the babble growth is mainly caused by the gas permeated from the outside of the recording head into the ink flow path, the bubble permeation coefficient is determined by the temperature of the flow path forming member. Then, if the temperature in the working environment is the same, the bubble growth curve is to become identical. However, as will be understood from FIG. 8, the bubble growth after the arrival suction differs depending on the storage temperatures before the arrival suction. Consequently, it seems unlikely that the bubble growth is mainly caused by the gas permeated from the outside of the recording head into the ink flow path.

Further, if the bubble growth is mainly caused by the separation of gas in the ink solution, the temperature is to be increased to cause the ink to generate bubbles. However, as will be understood from the curve of "STORE AT 15° C./USE AT 15° C.", even if the temperature is not changed, the bubbles in the recording head are growing.

Meanwhile, it is known that even if the working environments of the recording head are the same, the longer the recording head is stored in low temperature environments before the arrival suction, the more the bubbles grow in the working environments. This leads to a conclusion that due to the storage in a low temperature environment, the gas molecules are gradually absorbed on the surface of the flow path forming member, and further, the gas molecules are dissolved in the flow path forming member. From the above-described reasons, it can be concluded that the bubble growth is mainly caused by desorption and separation of the gas molecules absorbed and dissolved in the flow path forming member into the ink.

A modeling method of the phenomenon of the bubble growth will be described. In reality, the bubble growth could be caused by gas externally permeated the flow path forming member and generated in the ink, the separation of the gas in the ink solution, or the like. However, in the exemplary embodiment, it is assumed that the bubble growth is caused by desorption and separation of the gas molecules absorbed and dissolved in the flow path forming member into the ink. In the description below, the amount of gas absorbed and dissolved in the flow path forming member is called an amount of gas in the member.

When the recording head is stored in a certain environment before the arrival suction (before ink filling) is performed, absorption and dissolution of the gas molecules in the air into the flow path forming member balances with desorption and separation of the gas molecules from the surface of the flow path forming member to the air, and thereby reaching an equilibrium. When the temperature of the member increases from the equilibrium state, the momentum of the gas molecules increases, and desorption and separation of the gas molecules from the flow path forming member proceeds. By contrast, when the temperature decreases, the absorption and dissolution of the gas molecules into the flow path forming member proceeds. In other words, before the ink is filled into the ink flow path, a certain amount of the gas molecules is absorbed and dissolved in the flow path forming member. After the arrival suction (after the ink filling) is performed, bubbles in the ink flow path grow because the absorption and dissolution of the gas molecules into the surface of the flow path forming member decreases due to the substitution of the material coming in contact with the surface of the flow path forming member from the air to the ink.

As will be understood from FIG. 8, when the temperature does not change after the arrival suction (after the ink filling), the bubble growth amount asymptotically approaches to a certain value. This shows that after the arrival suction (after the ink filling), the gas stored in the flow path forming member is gradually released into the ink flow path and approaching to an equilibrium state. The gas molecules desorb and separate from the flow path forming member after the arrival suction (after the ink filling). The value to which the amount of gas in the flow path forming member asymptotically approaches is defined as an amount of gas in equilibrium. In other words, the amount of gas absorbed and dissolved in the flow path forming member after the ink is filled into the ink flow path and adequate time has passed is defined as the amount of gas in equilibrium.

Figure 9:
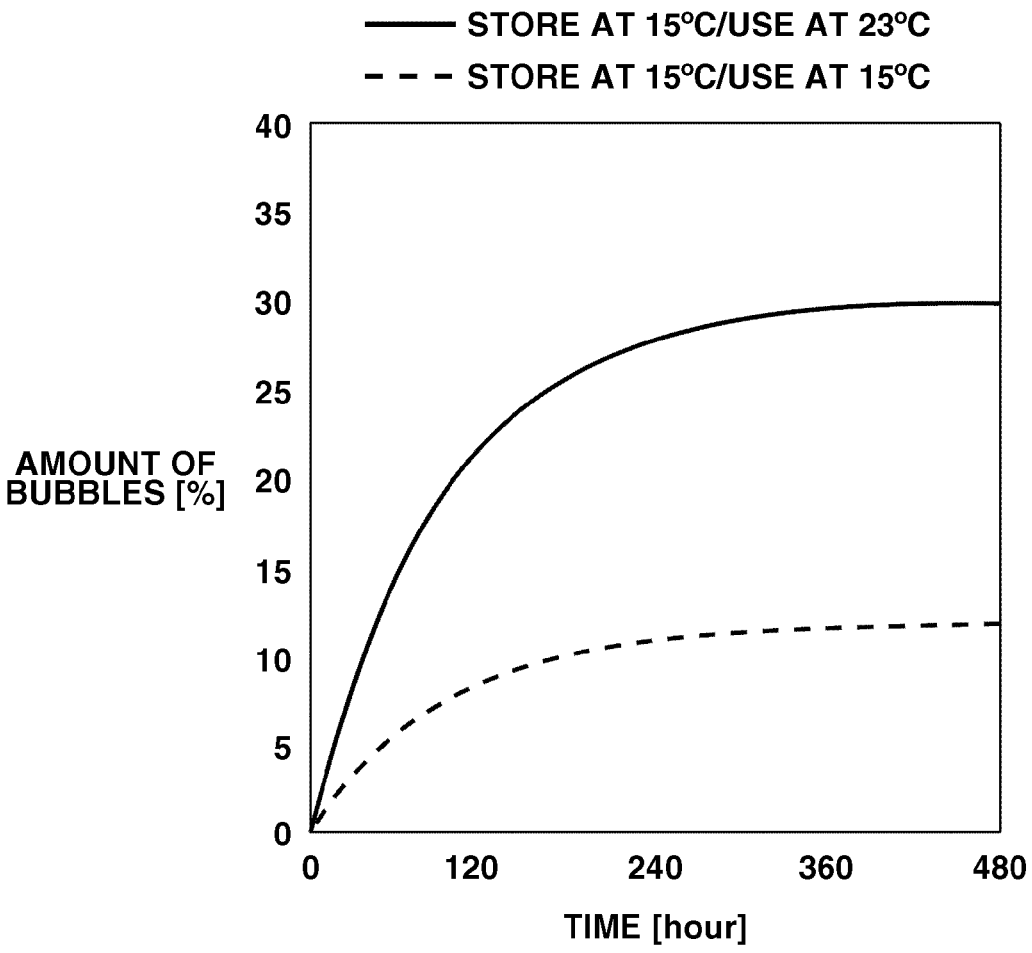
FIG. 9 is a diagram illustrating change in the amount of bubbles due to differences in temperatures the recording head is used after arrival suction is performed.

FIG. 9 is a diagram illustrating change in the amount of bubbles due to differences in temperatures at which the recording head is used after the arrival suction is performed.

In FIG. 9, the bubble growth curve observed in the environment of "STORE AT 15° C./USE AT 23° C." is illustrated. In the environment, the recording head is stored in the environment of the temperature of 15° C. and the humidity of 10% for one month in a state the ink is not filled, and the arrival suction is performed in the working environment of the temperature of 23° C. In FIG. 9, the bubble growth curve observed in the environment of "STORE AT 15° C./USE AT 15° C." is illustrated. In the environment, the recording head is stored in the environment of the temperature of 15° C. and the humidity of 10% for one month in a state the ink is not filled, and the arrival suction is performed in the working environment of the temperature of 15° C. In FIG. 9, the storage temperatures are the same, and consequently, the amounts of gas absorbed and dissolved in the flow path forming member are the same. However, depending on differences of the working temperatures, the bubble growth amounts differ. This indicates that the amount of gas in equilibrium depends on temperatures.

Accordingly, the bubble growth amount can be explained by the amount of gas absorbed and dissolved in the flow path forming member at the arrival suction and the amount of gas in equilibrium after the arrival suction (after the ink filling). Further, the amount of gas in the flow path forming member at the arrival suction depends on the storage temperature, and the amount of gas in equilibrium depends on the temperature in the head. In other words, the bubble growth amount can be calculated by experimentally determining the relationship between the amount of gas in the flow path forming member and the storage temperature, and the relationship between the amount of gas in equilibrium and the temperature in the head.

FIG. 10 is a diagram illustrating maximum amounts of the bubble growth when storage temperatures and the working temperatures are changed. A maximum amount of the bubble growth is a difference between an amount of gas in the flow path forming member at a storage temperature and an amount of gas in equilibrium at a working temperature.

Figure 11:
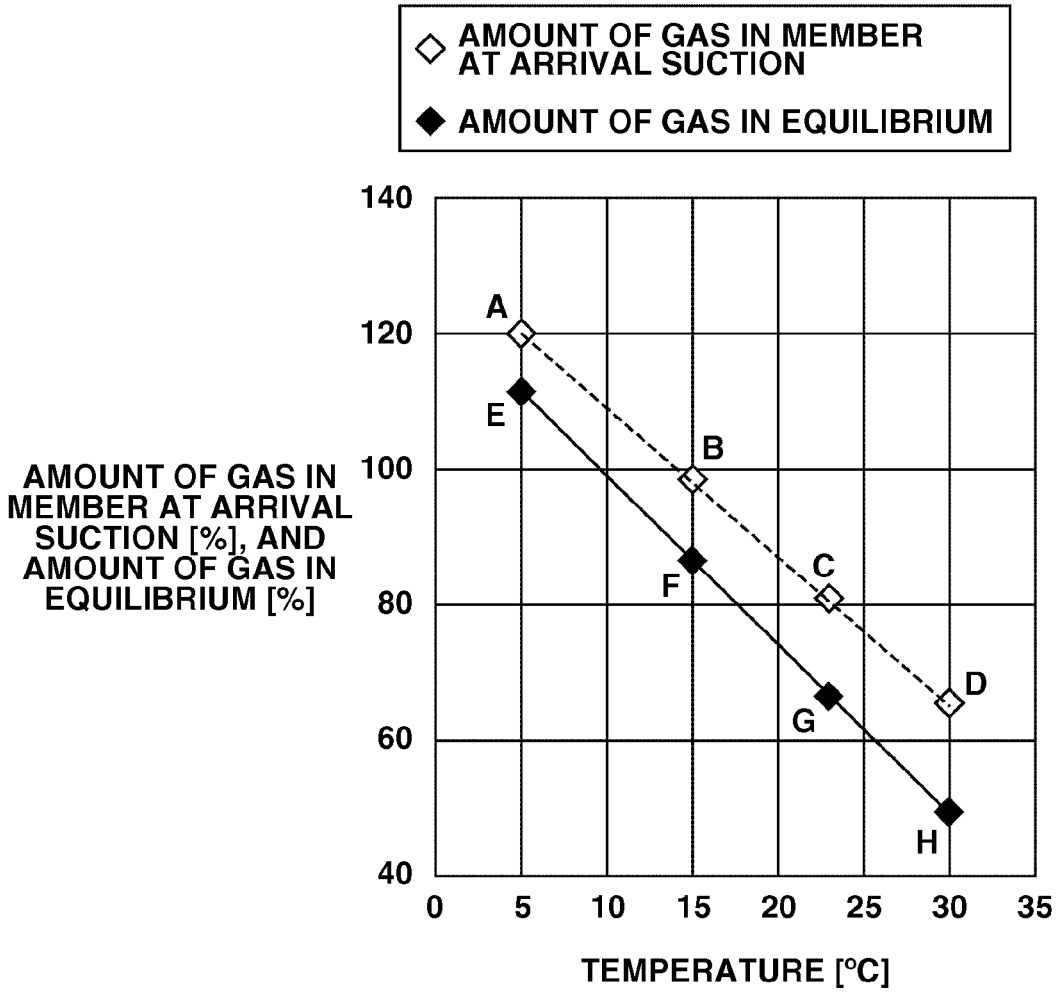
FIG. 11 is a plot of a relationship between the amounts of gas in the flow path forming member at arrival suction and the amounts of gas in equilibrium.

FIG. 11 is a plot of the relationships between the amounts of gas in the flow path forming member at arrival suction and the amounts of gas in equilibrium calculated from the relationship among the storage temperatures, the working temperatures, and the maximum amounts of the bubble growth in FIG. 10. In FIG. 11, the point A indicates the amount of gas in the flow path forming member at the arrival suction after storage at the temperature of 5° C. The point E indicates the amount of gas in equilibrium at the working temperature of 5° C. The difference becomes the maximum amounts of the bubble growth in the present condition.

From FIG. 11, the relationship between the amounts of gas in the flow path forming member at the arrival suction and the amounts of gas in equilibrium and the temperatures can be determined in the linear equation. In the exemplary embodiment, if the intercept is set such that the amount of gas in equilibrium at the temperature of 50° C. is to be zero, the storage temperature is Th, the working temperature is Ts, the amount of gas in the flow path forming member at the arrival suction is $H_0$, and the amount of gas in equilibrium is A, the relationship can be expressed as in equations (1) and (2).

$$H_0=a_H\times Th+b_H \tag{1}$$

($a_H$=−2.18, $b_H$=131.01)

$$A=a_A\times T_S+b_A \tag{2}$$

($a_A$=−2.47, $b_A$=123.67)

Figure 12:
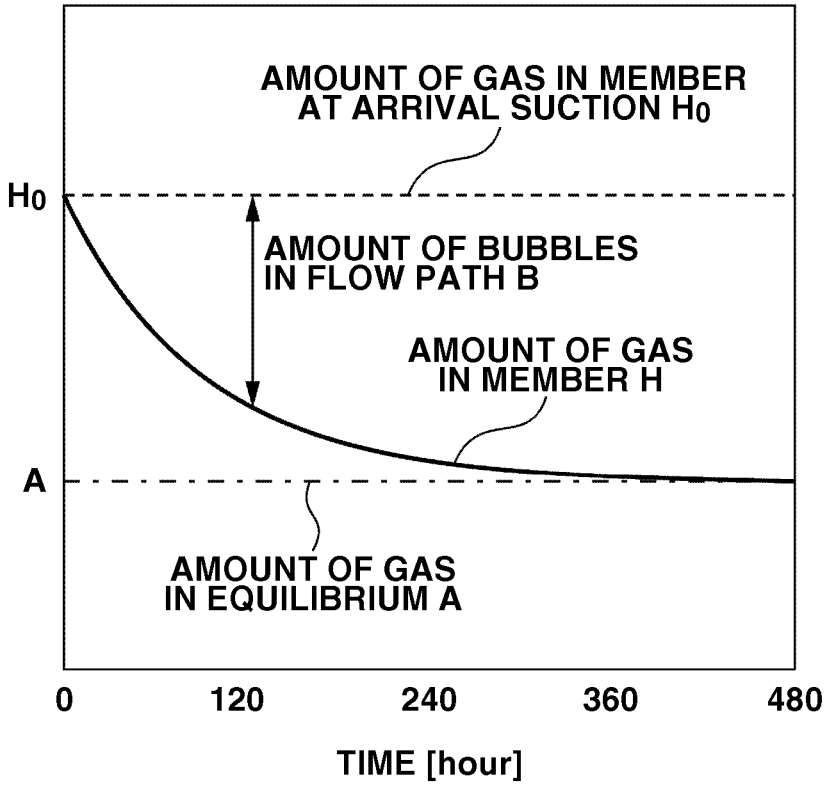
FIG. 12 is a diagram illustrating a state the release and the elution of gas molecules absorbed and dissolved in the flow path forming member at the time of arrival suction is gradually proceeding to an amount of gas in equilibrium.

A modeling method of the relationship between the bubble growth and time will be described. FIG. 12 is a diagram illustrating a state desorption and elution of gas molecules absorbed and dissolved in the flow path forming member at the time of arrival suction is gradually proceeding to an amount of gas in equilibrium. In FIG. 12, a decrease from the amount H of gas in the flow path forming member at the arrival suction becomes bubbles in the ink flow path. In other words, if the amount of gas in the flow path forming member is $H_{(t)}$, the amount of bubbles B in the ink flow path can be expressed as in equation (3), where t represents the elapsed time (hour) from the arrival suction.

$$B=H_0-H_{(t)} \tag{3}$$

The rate of decrease of the amount of gas $H_{(t)}$ in the flow path forming member, that is, the growth rate of bubbles in the ink flow path will be described. From the observed shapes of the bubble growth curves in FIGS. 8 to 10, it is expected that the bubble growth rate is proportional to the difference between the amount of gas in the flow path forming member and the amount of gas in equilibrium. Accordingly, the differential dH/dt of the amount of gas $H_{(t)}$ in the flow path forming member can be expressed as in equation (4), where the proportionality constant is p.

$$dH/dt=-p\times(H_{(t)}-A) \tag{4}$$

If $H_{(0)}=H_0$, from equations (3) and (4), the relationship between the amount B of bubbles in the ink flow path and the elapsed time t from arrival suction can be expressed as in equation (5).

$$B(t)=(H_0-A)\times(1-e^{-pt}) \tag{5}$$

In equation (5), to determine p, if curve fitting is performed using the bubble growth curves in FIGS. 8 to 10, p=0.011 is acquired. The proportionality constant p is a value determining the rate of growth of bubbles, and hereinafter, the proportionality constant p is called a bubble growth coefficient.

Figure 13:
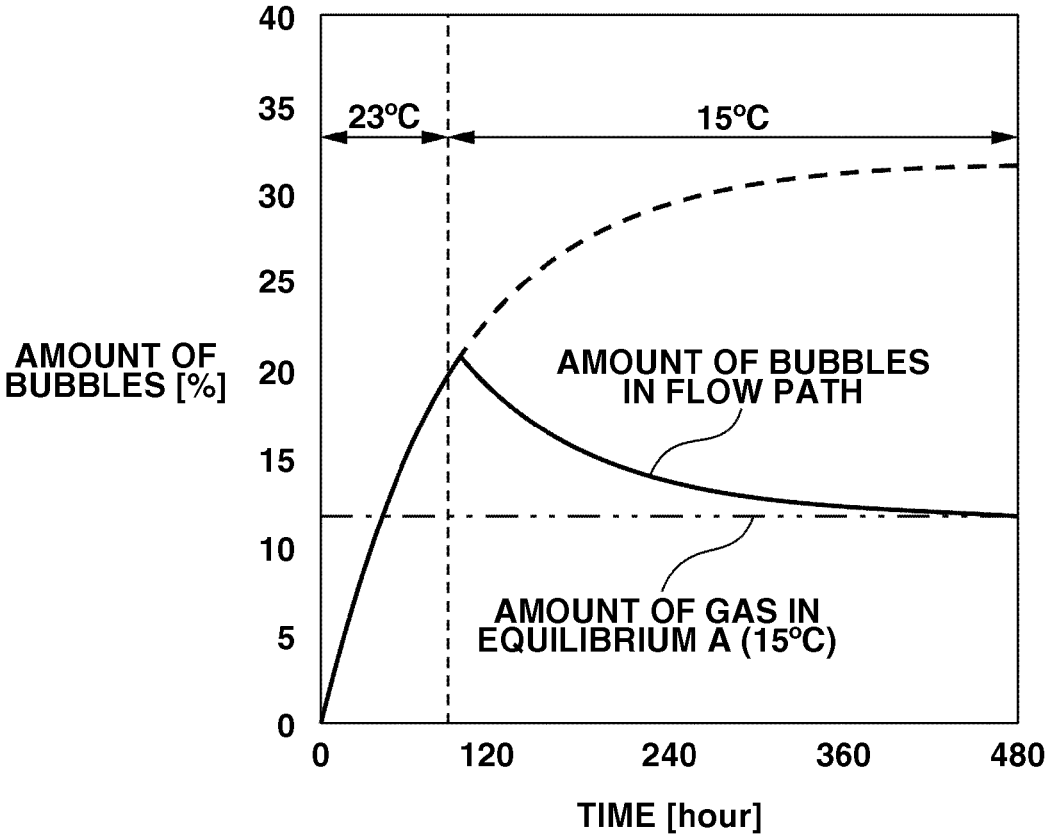
FIG. 13 is a diagram illustrating a bubble growth curve of the recording head left for 96 hours in the condition of the storage temperature of 15° C. and the working temperature of 23° C. after arrival suction and the working temperature is changed to 15° C.

Meanwhile, it is known that as the temperature in the head decreases, the amount of bubbles in the ink flow path decreases. FIG. 13 is a diagram illustrating the bubble growth curve of the recording head left for 96 hours in the condition of the storage temperature of 15° C. and the working temperature of 23° C. after arrival suction is performed and the working temperature is changed to 15° C. It is understood that after the change of the working temperature, the amount of bubble in the ink flow path changes to the amount of gas in equilibrium at 15° C. It is conceivable that with the decrease of the temperature in the head, the amount of gas in equilibrium increases and exceeds the amount of gas in the flow path forming member, and thereby the gas molecules in the ink flow path are absorbed and dissolved in the flow path forming member again.

The defoam occurs when $H_0-A<0$ in equation (5). It is conceivable that the defoaming rate varies depending on the flow path forming member. Consequently, it is desirable to classify by plus and minus of $H_0-A$ and use different coefficients. In the exemplary embodiment, as a result of the measurement, it is possible to directly use the bubble growth coefficient p for defoam.

Figure 14:
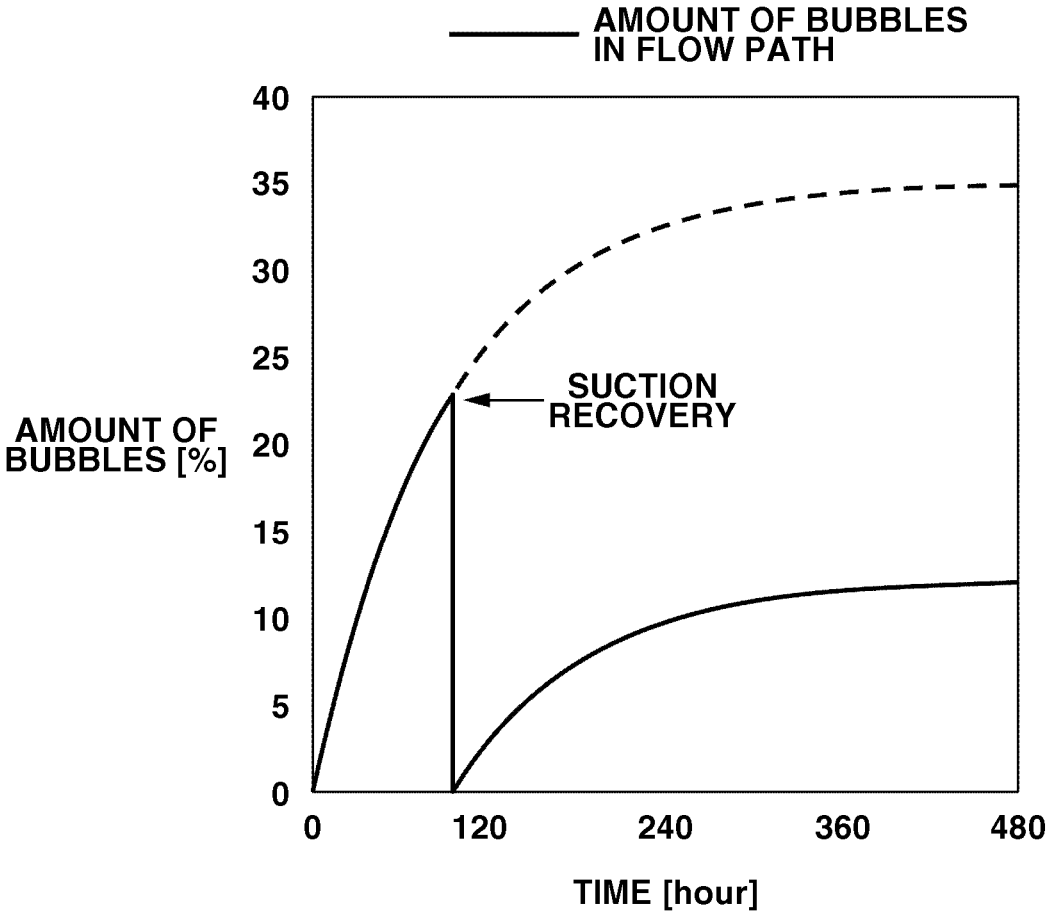
FIG. 14 is a diagram illustrating a bubble growth curve of the recording head in the condition of the storage temperature of 5° C. and the working temperature of 15° C.

Further, it is known that the bubble growth rate does not depend on the amount of bubbles in the ink flow path. FIG. 14 is a diagram illustrating the bubble growth curve of the recording head in the condition of the storage temperature of 5° C. and the working temperature of 15° C. In FIG. 14, the solid line indicates the amounts of bubble when suction recovery is performed after 96 hours has passed since arrival suction and bubbles are removed from the ink flow path. The dashed line indicates the amounts of bubble when suction recovery was not performed after 96 hours had passed since arrival suction. From FIG. 14, it is understood that even if the amount of bubble in the ink flow path decreased by the suction recovery, the bubble growth amount after the suction recovery does not change.

However, in reality, the temperature in the working environment of the inkjet recording apparatus is changing every second. Consequently, the amount of gas in equilibrium is not constant, and the bubble growth amount B cannot be expressed in the simple mathematical expression as in equation (5). Accordingly, to accurately estimate the amount of bubble in the ink flow path, time is divided at a timing, and a differential of the amount of bubble ΔB in the divided time period is to be calculated from the amount of gas in the flow path forming member and the amount of gas in equilibrium at each timing, and the values are to be accumulated.

In the exemplary embodiment, the differential of the amount of bubble ΔB is calculated and accumulated every one hour, however, the time dividing method is not limited to the regular intervals. The differential of the amount of bubble ΔB can be calculated to a time period having arbitrary length by proportioning the bubble growth coefficient p to the divided time. Differential of an amount of bubble H in the flow path forming member is expressed by equation (4), and consequently, a differential of the amount of bubbles ΔB in one hour can be expressed as in equation (6).

$$\Delta B = p \times (H - A) \quad (p = 0.011) \tag{6}$$

Where, the current amount of bubbles in the ink flow path is $B_{(N)}$, the current amount of gas in the flow path forming member is $H_{(N)}$, and the current amount of gas in equilibrium is $A_{(N)}$.

Further, the amount of bubbles in the ink flow path in one step before (one hour ago) is $B_{(N-1)}$, the amount of gas in the flow path forming member in one step before is $H_{(N-1)}$, and the amount of gas in equilibrium in one step before is $A_{(N-1)}$. Then, the differential ΔB can be expressed by the following expressions (7) to (10).

$$\Delta B = p \times (H_{(N-1)} - A_{(N-1)}) \tag{7}$$

(p=0.011)

$$B_{(N)} = B_{(N-1)} + \Delta B \tag{8}$$

$$H_{(N)} = H_{(N-1)} - \Delta B \tag{9}$$

$$A_{(N)} = a_A \times T_{S(N)} + b_A \tag{10}$$

($a_A$=−2.47, $b_A$=123.67)

By using the above-described model, the bubble growth corresponding to the temperature change in the working environment can be accurately calculated.

Figure 15:
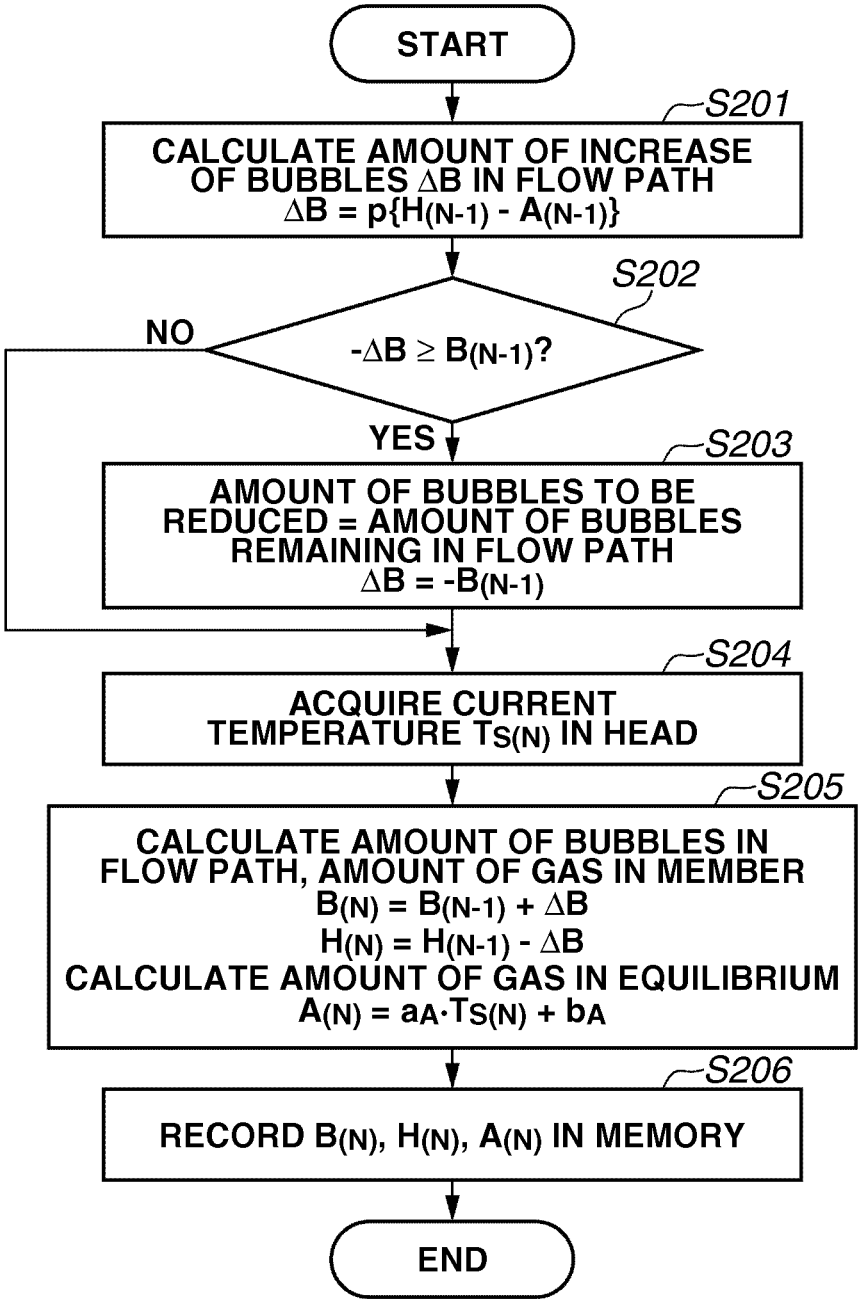
FIG. 15 is a flowchart for estimating an amount of bubbles.

Actual control in the above-described model will be described. FIG. 15 is a flowchart for estimating an amount of bubbles. The bubble amount estimation processing starts using a trigger that the count value of the timer 103 reaches one hour. In step S201, the control unit 101 calculates an amount of increase of bubbles ΔB in the ink flow path. In the calculation, using an amount of gas $H_{(N-1)}$ in the flow path forming member one hour ago recorded in the memory, and an amount of gas $A_{(N-1)}$ in equilibrium, the control unit 101 calculates the amount as in equation (7).

If the value ΔB is minus, bubbles in the ink flow path decreases. However, if the absolute value of the value ΔB is greater than the amount of bubbles $B_{(N-1)}$ in the ink flow path one hour ago, the amount of bubbles in the ink flow path has a negative value. Consequently, in step S202, the control unit 101 compares the amount of bubbles $B_{(N-1)}$ in the ink flow path one hour ago to the amount of decrease of bubbles.

If the amount of decrease of bubbles (−ΔB) is greater than or equal to the amount of bubbles $B_{(N-1)}$ in the ink flow path one hour ago (YES in step S202), the processing proceeds to step S203. In step S203, it is set that $\Delta B = -B_{(N-1)}$, and the processing proceeds to step S204. If the amount of decrease of bubbles (−ΔB) is less than the amount of bubbles $B_{(N-1)}$ in the ink flow path one hour ago (NO in step S202), the processing proceeds to step S204.

In step S204, the temperature detection sensor 104 acquires the current temperature $T_{S(N)}$ in the head.

In step S205, according to equations (8) to (10), the inkjet recording apparatus calculate the current amount of bubbles $B_{(N)}$ in the ink flow path, the current amount of gas $H_{(N)}$ in the flow path forming member, and the current amount of gas $A_{(N)}$ in equilibrium. The current amount of gas $A_{(N)}$ in equilibrium is calculated using the current temperature $T_{S(N)}$ in the head acquired in step S204. In step S206, the inkjet recording apparatus stores the calculated amounts $B_{(N)}$, $H_{(N)}$, and $A_{(N)}$ in the memory 105, and starts counting of the timer 103.

When the count value of the timer 103 reaches one hour, the inkjet recording apparatus performs the above-described bubble amount estimation processing again. By repeating the processing, the amounts of bubbles $B_{(N)}$ in the ink flow path corresponding to the temperature change can be stored in the memory.

Figure 16:
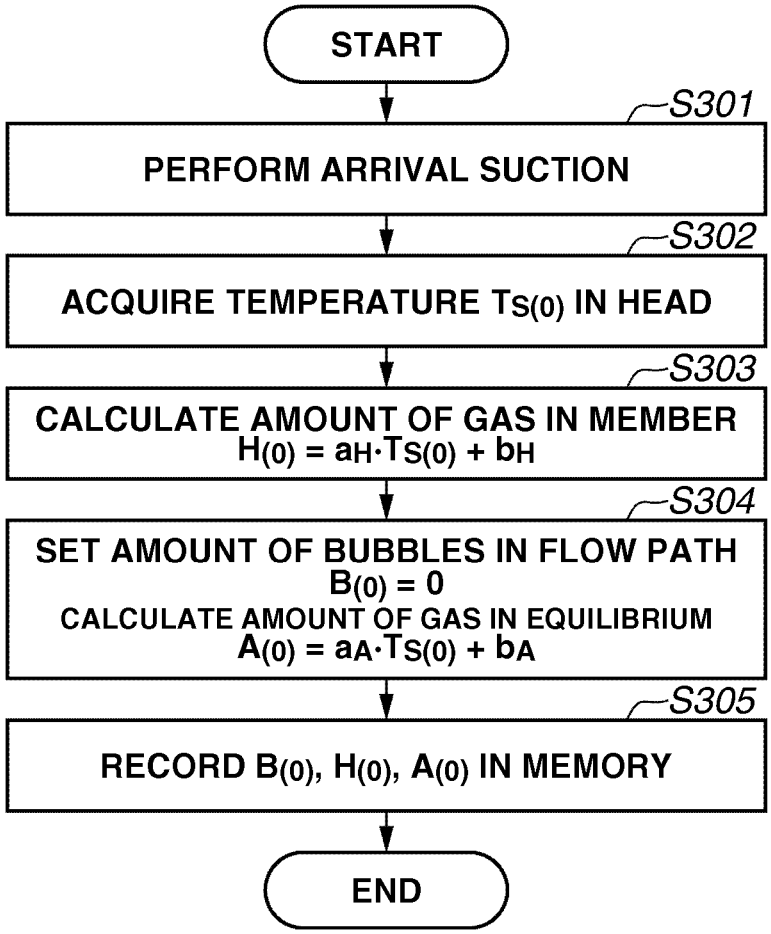
FIG. 16 is a flowchart illustrating a control procedure in arrival suction.

Settings, in arrival suction, of the amounts $B_{(N)}$, $H_{(N)}$, and $A_{(N)}$ used for the bubble amount estimation are described. FIG. 16 is a flowchart illustrating control performed in the arrival suction.

In step S301, the inkjet recording apparatus performs arrival suction operation. In step S302, the inkjet recording apparatus acquires the temperature $T_{S(0)}$ in the head. In step S303, the control unit 101 calculates the amount of gas $H_0$ in the flow path forming member in the arrival suction by equation (1) using Th for the temperature $T_{S(0)}$ in the head.

In the calculation of the amount $H_0$ of gas in the flow path forming member in the arrival suction, the temperature $T_{S(0)}$ is used. However, the recording head before the arrival suction may be stored in a low-temperature environment lower than the temperature of $T_{S(0)}$. If the recording head is stored in a low-temperature environment, the amount of gas molecules absorbed and dissolved in the flow path forming member is greater than the calculated value.

The growth rate of bubbles in the ink flow path is determined by the difference between the amount of gas in the flow path forming member and the amount of gas in equilibrium. Accordingly, as the amount of gas in the flow path forming member increases, the bubble growth rate increases, and thereby the amount of bubbles in the ink flow path reaches an amount which leads to discharge failure earlier than expected. To solve the problem, an offset can be set to the temperature in the arrival suction to the side lower than the temperature $T_{S(0)}$, and the amount of gas $H_0$ in the flow path forming member in the arrival suction can be calculated.

In step S304, the inkjet recording apparatus sets the amount of bubbles $B_{(0)}$ in the ink flow path and the amount of gas $A_{(0)}$ in equilibrium. In the exemplary embodiment, it is assumed that there is no bubble in the ink flow path right after the arrival suction, and the amount $B_{(0)}$ is set such that $B_{(0)}=0$. If the ink flow path is not fully filled with the ink, the amount $B_{(0)}$ may be set to a value greater than zero. The control unit 101 calculates the amount of gas $A_{(0)}$ in equilibrium by equation (2). In step S305, the control unit 101 stores the amounts $H_{(0)}$, $B_{(0)}$, and $A_{(0)}$ in the memory, and the processing in the arrival suction ends.

Next, the processing performed prior to the recording start will be described. In conventional timer suction, to remove bubbles in an ink flow path, suction timing is set by elapsed time since the last suction recovery operation. In the control according to the exemplary embodiment of the present invention, depending on a working environment of the inkjet recording apparatus, the amount of bubbles in the ink flow path may be kept to an amount in which discharge failure does not occur for a long time.

In such a case, the timing of automatic suction is determined not by the suction operation for removal of bubbles in the ink flow path but by suction operation for recovery from thickening and fixation of the ink in the nozzle. In the exemplary embodiment, to prevent discharge failure due to thickening and fixation of the ink in the nozzle, when 24 days or more has elapsed since the last suction operation before recording start, the weak suction operation is performed.

Figure 17:
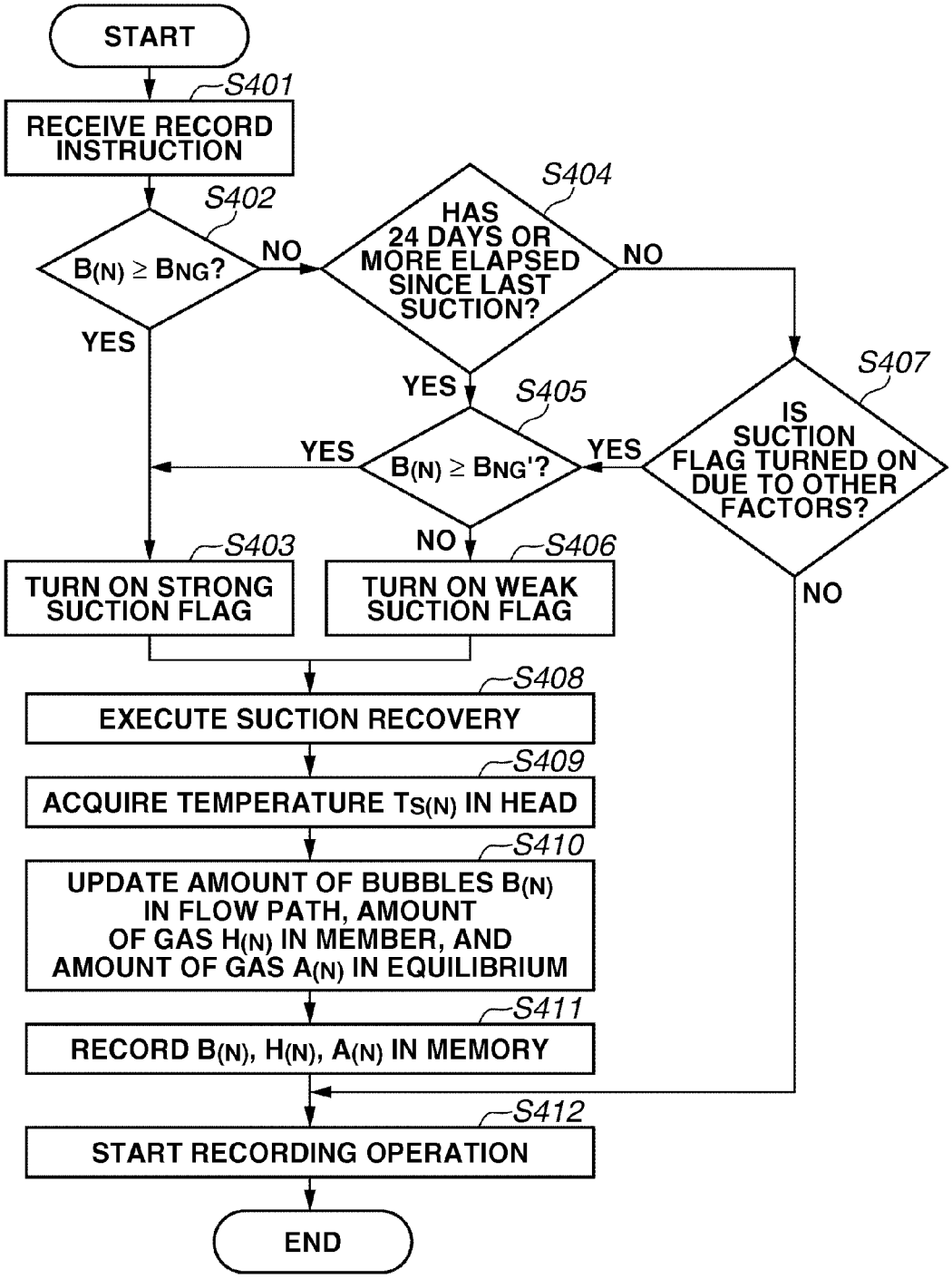
FIG. 17 is a flowchart illustrating a control procedure performed prior to the start of recording operation.

FIG. 17 is a flowchart illustrating the control performed prior to recording operation start. In step S401, the inkjet recording apparatus receives a record instruction. In step S402, the inkjet recording apparatus compares the amounts of bubbles $B_{(N)}$ in the ink flow path stored in the memory to the threshold $B_{NG}$(=5.0) of the amount of bubbles at which discharge failure may occur.

If $B_{(N)} \geq B_{NG}$ (YES in step S402), then in step S403, a strong suction flag is set. In this case, a plurality of levels of thresholds of the amount of bubbles can be provided, and a plurality of parameters for suction can be set. The parameters for suction are for changing the suction rate, the amount of suction, the number of times of suction, or the like. If $B_{(N)} < B_{NG}$ (NO in step S402), the processing proceeds to step S404. In step S404, the inkjet recording apparatus determines whether 24 days or more has elapsed since the last suction operation. If 24 days or more has elapsed since the last suction operation (YES in step S404), the processing proceeds to step S405. If 24 days has not elapsed since the last suction operation (NO in step S404), in step S407, the inkjet recording apparatus determines whether a suction flag is set due to a factor other than the amount of bubbles in the ink flow path. If a suction flag is set (YES in step S407), the processing proceeds to step S405. If a suction flag is not set (NO in step S407), the processing proceeds to step S412, and the recording processing is started.

In step S405, the inkjet recording apparatus compares the amount of bubbles $B_{(N)}$ in the ink flow path to $B_{NG'}$(=4.0). If $B_{(N)}$ $B_{NG'}$(YES in step S405), the processing proceeds to step S403. In step S403, the inkjet recording apparatus sets a strong suction flag. If $B_{(N)} < B_{NG'}$ (NO in step S405), the processing proceeds to step S406. In step S406, the inkjet recording apparatus sets a weak suction flag. In other words, in step S405, if a flag is set due to the other factors, depending on the amount of bubbles, the inkjet recording apparatus sets the strong suction flag.

In step S408, depending on the set flag, the inkjet recording apparatus performs suction recovery operation. If both of the strong suction flag and the weak suction flag are set, the inkjet recording apparatus performs the strong suction. In step S409, the control unit 101 acquires the temperature $T_{S(N)}$ in the head. In step S410, the inkjet recording apparatus updates the amount of bubbles $B_{(N-1)}$ in the ink flow path, the amount of bubbles $H_{(N-1)}$ in the flow path forming member, and the amount of gas $A_{(N-1)}$ in equilibrium stored in the memory.

An amount of removal of bubbles is set corresponding to the type of the suction operation performed in step S408. The amount of removal is subtracted from the amount of bubbles $B_{(N-1)}$ in the ink flow path stored in the memory. The amount of bubbles $H_{(N-1)}$ in the flow path forming member stored in the memory is substituted into the amount of bubbles H in the flow path forming member. The amount of gas $A_{(N)}$ in equilibrium is calculated according to equation (10) using the temperature $T_{S(N)}$ acquired in step S409.

In step S411, the inkjet recording apparatus stores the calculated amounts $B_{(N)}$, $H_{(N)}$, and $A_{(N)}$ in the memory 105. In step S412, the inkjet recording apparatus starts the recording operation.

Meanwhile, many inkjet recording apparatuses are not provided with a battery. In such inkjet recording apparatuses, it is not possible to continue the estimation of amounts of bubbles in a hard power off state. Therefore, at the last bubble amount estimation timing before hard power off, the inkjet recording apparatus stores the time, the amount of bubbles $B_{(N)}$ in the ink flow path, and the amount of gas $H_{(N)}$ in the flow path forming member in a nonvolatile memory. When the inkjet recording apparatus acquires the time from a PC or a network next time, the inkjet recording apparatus resets the amount of bubbles in the ink flow path and the amount of bubbles in the flow path forming member using the amount of bubbles $B_{last}$ in the ink flow path, the amount of gas $H_{last}$ in the flow path forming member, and the elapsed time since the last bubble amount estimation timing.

Figure 18:
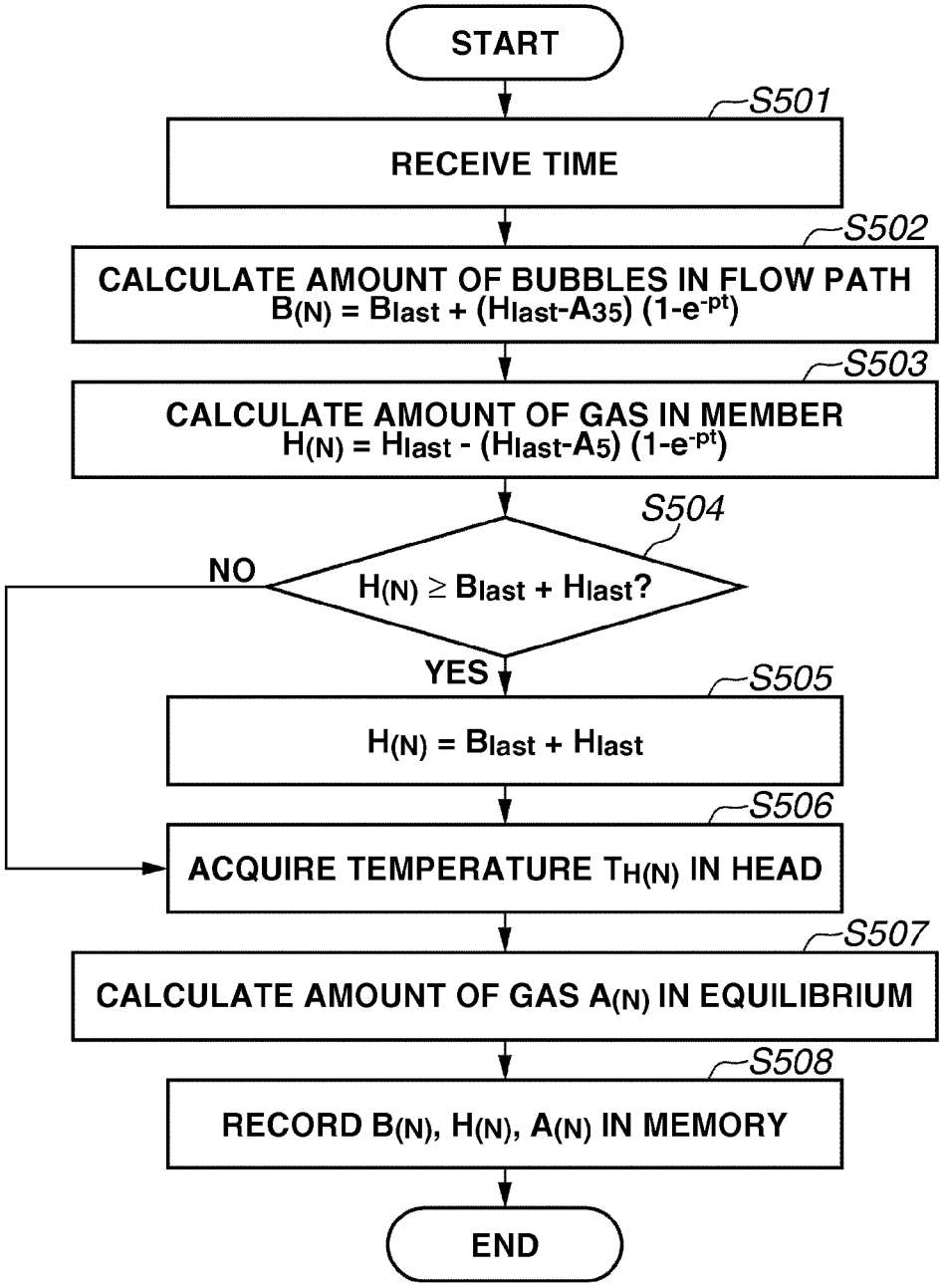

FIG. 18 is a flowchart illustrating a control procedure in initial time reception performed after hard power on. After hard power on, in step S501, the control unit 101 receives time, and calculates elapsed time $t_{last}$ from the time of the last bubble amount estimation timing stored in the nonvolatile memory. In step S502, the inkjet recording apparatus calculates a worst value of the amounts of bubbles in the ink flow path at the time of the initial time acquisition after hard power on, and sets the value as the value $B_{(N)}$.

Specifically, it is assumed that during the elapsed time $t_{last}$ calculated in step S501, the temperature in the recording head does not change from the temperature of 35° C. that is the upper limit in the environment in which the recording head is actually used. The growth of bubbles in the case there is no temperature change can be calculated as a function of time as in equation (5). Consequently, if the amount of gas in equilibrium at the temperature of 35° C. is A35, the amount of bubbles $B_{(N)}$ in the ink flow path can be calculated as in equation (11) as the sum of the amount of bubbles in the ink flow path at the last bubble amount estimation timing and the amount of growth of bubbles.

$$B_{(N)}=B_{last}(H_{last}-A35)\times(1-e^{-pt}) \tag{11}$$

In step S503, the control unit 101 calculates the amount of gas in the flow path forming member. It is assumed that as the worst case of the amount of gas in the flow path forming member at the initial time acquisition after hard power on, during the elapsed time $t_{last}$, the temperature in the recording head does not change from the temperature of 5° C. that is the lower limit in the environment the recording head is actually used. The control unit 101 calculates the amount using the amount A5 of gas in equilibrium at the temperature of 5° C. as in equation (12).

$$H_{(N)}=H_{last}-(H_{last}-A35)\times(1-e^{-pt}) \tag{12}$$

Where, if all of bubbles in the ink flow path are absorbed and dissolved in the flow path forming member in the low-temperature environment, the gas molecule supply source is lost, and thereby the maximum value of the amount of gas in the flow path forming member is $B_{last}+H_{last}$. In step S504, the control unit 101 compares the calculation result of equation (12) to the value of $B_{last}+H_{last}$. If the result is $H_{(N)} \geq B_{last}+H_{last}$ (YES in step S504), in step S505, equation $H_{(N)}=B_{last}+H_{last}$ is set.

In step S506, the control unit 101 acquires the temperature $T_{S(N)}$ in the head. In step S507, the inkjet recording apparatus calculates the amount of gas $A_{(N)}$ in equilibrium. In step S508, the inkjet recording apparatus stores the calculated amounts $B_{(N)}$, $H_{(N)}$, and $A_{(N)}$ in the memory, and after hard power on, the processing performed at the initial time acquisition ends.

Further, depending on the value of the amount of bubbles $B_{(N)}$ in the ink flow path, with the configuration for controlling the maximum duty at the recording operation, occurrence of discharge failure due to bubbles in the ink flow path can be prevented.

By performing the above-described control, the amount of bubbles generated in the ink flow path can be estimated. Further, by performing the control corresponding to the amount of bubbles, occurrence of discharge failure can be suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-161442 filed Jul. 23, 2011, which is hereby incorporated by reference herein in its entirety.

What is claimed is:

1. An inkjet recording apparatus comprising:

a recording head including a nozzle for discharging ink and a flow path forming member forming an ink flow path for supplying ink to the nozzle;

a detection unit configured to detect a temperature in the recording head;

a calculation unit configured to calculate an amount of bubbles in ink on the basis of a first amount of gas estimated to exist within the flow path forming member based on a temperature detected by the detection unit before the flow path is filled with ink and a second amount of gas estimated to be able to exist within the flow path forming member based on a temperature detected by the detection unit when the flow path is in a state of being filled with ink; and a suction unit configured to suck the ink from the recording head based on a result calculated by the calculation unit.

2. The inkjet recording apparatus according to claim 1, wherein the inkjet recording apparatus is stored in a state the ink is not filled in the ink flow path.

3. The inkjet recording apparatus according to claim 1, wherein the control unit is configured, based on an amount of bubbles in the ink flow path of the one step before, the current amount of gas in the flow path forming member, and the current amount of gas in equilibrium, to calculate a current amount of bubbles in the ink flow path.

4. The inkjet recording apparatus according to claim 1, further comprising:

a timer configured to measure the elapsed time since the control unit calculates the amount of bubbles in the ink flow path.

5. The inkjet recording apparatus according to claim 1, further comprising:

a memory configured to store the amounts of bubbles in the ink flow path changing over time.

6. The inkjet recording apparatus according to claim 1, wherein the first amount of gas is larger when the detected temperature is a first temperature than when the detected temperature is a second temperature, which is higher than the first temperature.

7. The inkjet recording apparatus according to claim 1, wherein the second amount of gas is larger when the detected temperature is a first temperature than when the detected temperature is a second temperature, which is higher than the first temperature.

8. The inkjet recording apparatus according to claim 1, wherein the second amount of gas of when the detected temperature is a first temperature is smaller than the first amount of gas of when the detected temperature is the first temperature.

9. A suction control method in an inkjet recording apparatus including a recording head including a nozzle for discharging ink and a flow path forming member forming an ink flow path for supplying the ink to the nozzle, the method comprising:

performing a first estimation of estimating a first amount of gas existing within the flow path forming member based on a temperature before the flow path is filled with ink;

performing a second estimation of estimating a second amount of gas being able to exist within the flow path forming member based on a temperature of when the flow path is filled with ink; and sucking ink from the recording head based on the first amount of gas and the second amount of gas.

* * * * *